US010512314B2

(12) United States Patent
Holliday, Jr. et al.

(10) Patent No.: US 10,512,314 B2
(45) Date of Patent: Dec. 24, 2019

(54) SLIDE FASTENER STOP MEMBER

(71) Applicant: YKK Corporation, Tokyo (JP)

(72) Inventors: John Holliday, Jr., Kurobe (JP); Ryuji Yamazaki, Kurobe (JP); Shigeyoshi Takazawa, Kurobe (JP); Jiro Nozaki, Kurobe (JP); Yoshinori Kojima, Kurobe (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 16/141,428

(22) Filed: Sep. 25, 2018

(65) Prior Publication Data

US 2019/0090597 A1 Mar. 28, 2019

(30) Foreign Application Priority Data

Sep. 26, 2017 (JP) ..... 2017-004405

(51) Int. Cl.
*A44B 19/36* (2006.01)
*A44B 19/12* (2006.01)

(52) U.S. Cl.
CPC ..... *A44B 19/36* (2013.01); *A44B 19/12* (2013.01)

(58) Field of Classification Search
CPC ..... A44B 19/12; A44B 19/36
See application file for complete search history.

(56) References Cited

U.S. PATENT DOCUMENTS

| | | | | |
|---|---|---|---|---|
| 3,959,858 A * | 6/1976 | Fukuroi | ..... | A44B 19/36 24/435 |
| 4,825,514 A * | 5/1989 | Akeno | ..... | A44B 19/32 24/387 |
| 9,138,033 B2 | 9/2015 | Kojima et al. | | |
| 2009/0019675 A1 | 1/2009 | Peano | | |
| 2014/0157555 A1* | 6/2014 | Takazawa | ..... | A44B 19/32 24/436 |

FOREIGN PATENT DOCUMENTS

JP 2008-284358 A 11/2008

* cited by examiner

*Primary Examiner* — Robert Sandy
*Assistant Examiner* — David M Upchurch
(74) *Attorney, Agent, or Firm* — Kilpatrick Townsend & Stockton LLP

(57) ABSTRACT

A stop member may include: a main body fixed to both fastener tapes of a slide fastener, the main body including a first portion arranged on first tape surfaces of the fastener tapes and a second portion arranged on second tape surfaces, the second tape surfaces being opposite to the first tape surfaces; and at least one leg fixed to at least one fastener tape and coupled to the first portion of the main body, the leg extending away from the main body and covering a first region of the first tape surface of the fastener tape. The second tape surface may include a second region that is opposite to the first region of the first tape surface and includes a bare region of the second tape surface. The bare region may extend from a peripheral wall surface of the second portion toward a terminal end of the leg.

20 Claims, 9 Drawing Sheets

SLIDE FASTENER STOP MEMBER

CROSS-REFERENCE TO RELATED APPLICATION

The present application claims a priority of Japanese Utility-model Application No. 2017-004405, filed on Sep. 26, 2017 and entitled "Stop member included in Slide fastener", the entire contents of which is hereby incorporated by reference.

TECHNICAL FIELD

The present disclosure relates to a stop member included in a slide fastener.

BACKGROUND

Japanese Patent Application Laid-open No. 2008-284358 discloses a plastic (resin-made) stop member for improving waterproofness or water-tightness of a slide fastener. This literature describes at paras. 0011, 0030 that a taper fitting would be achieved when a slider and an upper stop are perfectly coupled.

U.S. Pat. No. 9,138,033 Specification also discloses a plastic (resin-made) stop member for improving waterproofness or water-tightness of a slide fastener. As shown in FIG. 16 of this literature, a coupling pillar (connecting neck) of a slider is sandwiched between extended portions (first and second extended portions).

SUMMARY

A stop member may be provided with a leg, which can be inserted into a slider, for improving waterproofness or water-tightness of a slide fastener or for other purposes, e.g. for facilitating positioning of a slider. The stop member may be produced by arranging a fastener tape in a mold and supplying a melt, e.g. melt plastic, into a cavity of the mold. Therefore, the fastener tape may possibly be shaken or displaced in the cavity of the mold due to supply pressure or flow of the melt. Common technical presumption is that, from such an aspect, the leg should be shaped to have top and bottom halves above and below the fastener tape which are shaped identically, thereby equalizing flow of melt in the top half of the cavity above the fastener tape and flow of melt in the bottom half of the cavity below the fastener tape. However, in such a case, the leg tends to be greater in size, possibly reducing the flexibility of a slide fastener.

A stop member according to an aspect of the present disclosure has been invented against the teaching of the above-described technical presumption. This stop member may include:

- a main body fixed to both fastener tapes of a slide fastener, the main body including a first portion arranged on first tape surfaces of the fastener tapes and a second portion arranged on second tape surfaces of the fastener tapes, the second tape surfaces being opposite to the first tape surfaces; and
- at least one leg fixed to at least one fastener tape and coupled to the first portion of the main body, the leg extending away from the main body and covering a first region of the first tape surface of the fastener tape, wherein
- the second tape surface includes a second region that is opposite to the first region of the first tape surface and includes a bare region of the second tape surface, the bare region extending from a peripheral wall surface of the second portion toward a terminal end of the leg.

In some embodiments, the leg may be provided with a hole that reaches the first tape surface of the fastener tape.

In some embodiments, the hole may be positioned on the opposite side of the peripheral wall surface and/or may be offset toward the terminal end of the leg relative to the peripheral wall surface.

In some embodiments, the hole may be defined by a wall surface including a first wall surface region; the peripheral wall surface of the second portion may include a second wall surface region; and the first and second wall surface regions may extend along a common axial line that is orthogonal to the tape surface of the fastener tape.

In some embodiments, a first extended line of the first wall surface region and a second extended line of the second wall surface region may cross at a point between the first and second tape surfaces of the fastener tape.

In some embodiments, a length of the first wall surface region along the axial line may be greater than a length of the second wall surface region along the axial line.

In some embodiments, the hole may be provided so as to form a groove on the peripheral wall surface of the leg.

In some embodiments, the hole may be provided to facilitate pivoting of the leg.

In some embodiments, the second portion may have a recessed portion that is recessed in accordance with a front contour of a top or bottom wing of a slider of the slide fastener.

In some embodiments, the recessed portion may include first and second protrusions extending toward the terminal end of the leg, a distance between the first and second protrusions may be gradually increased as the first and second protrusions extend toward the terminal end of the leg.

In some embodiments, the recessed portion may include:

- a continuous arc surface that is recessed in accordance with the front contour of the top or bottom wing; and
- first-side and second-side wall surfaces extending along an elongated direction of the fastener tape, and wherein
- a first protrusion is at least partially defined by the first-side wall surface and the arc surface, and a second protrusion is at least partially defined by the second-side wall surface and the arc surface.

In some embodiments, the leg may be provided with a hole that reaches the first tape surface of the fastener tape, and wherein

- (i) the hole may be provided on the opposite side of the peripheral wall surface positioned at a terminal end of the first or second protrusion, and may be offset toward the terminal end of the leg relative to the peripheral wall surface; or
- (ii) a first wall surface region included in a wall surface defining the hole and a second wall surface region included in the peripheral wall surface positioned at a terminal end of the first or second protrusion may extend along a common axial line that is orthogonal to the tape surface of the fastener tape.

In some embodiments, the leg may be flexible enough to be entrained by the fastener tape to which the leg is fixed.

In some embodiments, an end of a coil-like fastener element included in the slide fastener may be embedded in the leg.

An aspect of the present disclosure may allow or facilitate that a leg half portion is not formed on one of fastener tapes.

DETAILED DESCRIPTION

Hereinafter, non-limiting exemplary embodiments of the present invention will be described with references to FIGS. 1 to 12. One or more disclosed exemplary embodiments and respective features included in the exemplary embodiments are not mutually exclusive. A skilled person would properly combine the respective exemplary embodiments and/or respective features without requiring excess descriptions. A skilled person would also understand synergic effects by such combinations. Overlapping descriptions among exemplary embodiments will be basically omitted. Referenced drawings are mainly for the purpose of illustrating an invention and may possibly be simplified for convenience of illustration.

A plurality of features described for one slide fastener may be understood as a combination of features, but may be understood as an individual feature independent to other features. The individual feature should be understood as not limited to a particular disclosed slide fastener but effective to other undisclosed slide fasteners. The individual feature may be understood as a combination with other one or more features. Enumerating all possible combinations of features would be redundant for a skilled person in the art, and thus omitted. In the present specification, an individual feature may be explicitly distinguished from other descriptions by particular expressions such as "in some embodiments" and "in some cases".

In the present disclosure, terms related to directions would be understood as follows. Front-rear direction is equal to a moving direction of a slider. Frontward is identical to a direction of frontwardly moving slider for engaging pairs of fastener elements. Rearward is identical to a direction of rearwardly moving slider for disengaging pairs of engaged fastener elements. Up-down direction is orthogonal to the front-rear direction and is orthogonal to a tape surface of a fastener tape. Up-down direction is equal to an extending direction of a coupling pillar that couples upper and bottom wings of a slider. Left-right direction is orthogonal to the front-rear direction and the up-down direction. Each direction may be redefined by alternative expression based on the following descriptions.

Figure 1:
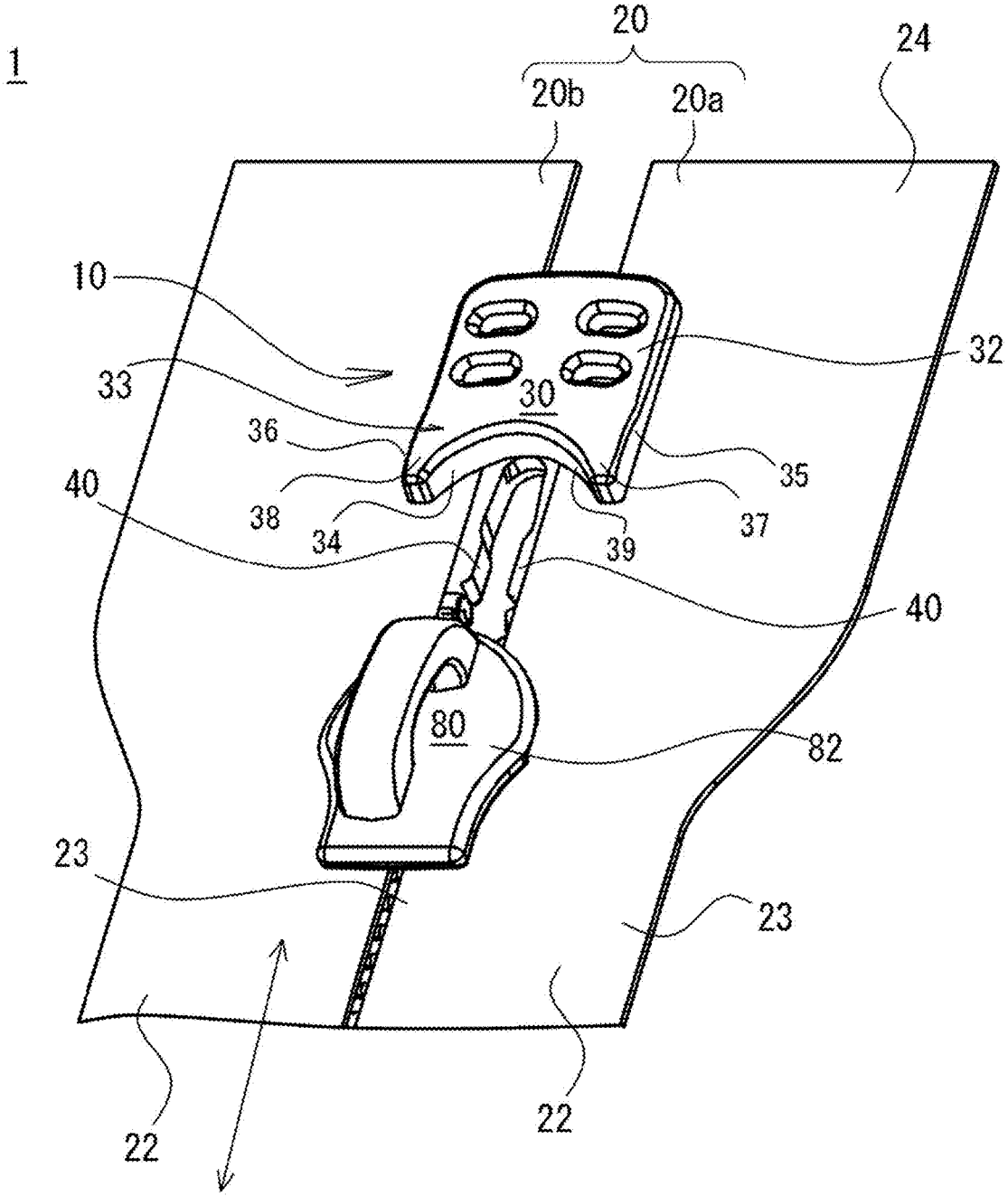
FIG. 1 is a schematic perspective view of a first end of a slide fastener according to an aspect of the present disclosure, showing a second surface of a fastener tape. The stop member and the slider are not coupled, and a second portion of a main body of the stop member do not touch the slider.
Figure 2:
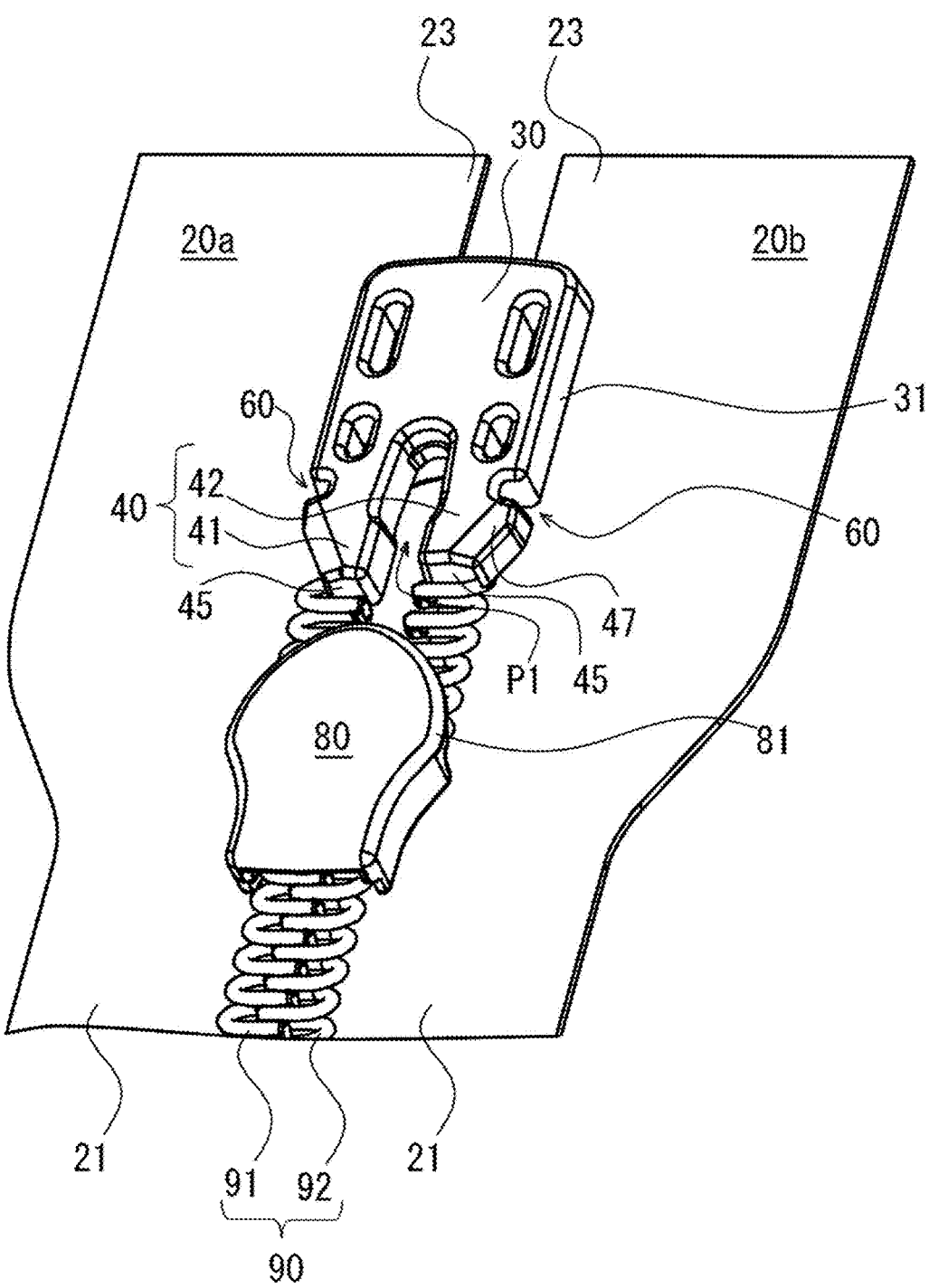
FIG. 2 is a schematic perspective view of a first end of a slide fastener according to an aspect of the present disclosure, showing a first surface of a fastener tape. The stop member and the slider are not coupled, and thus legs of the stop member are not inserted into the slider.
Figure 3:
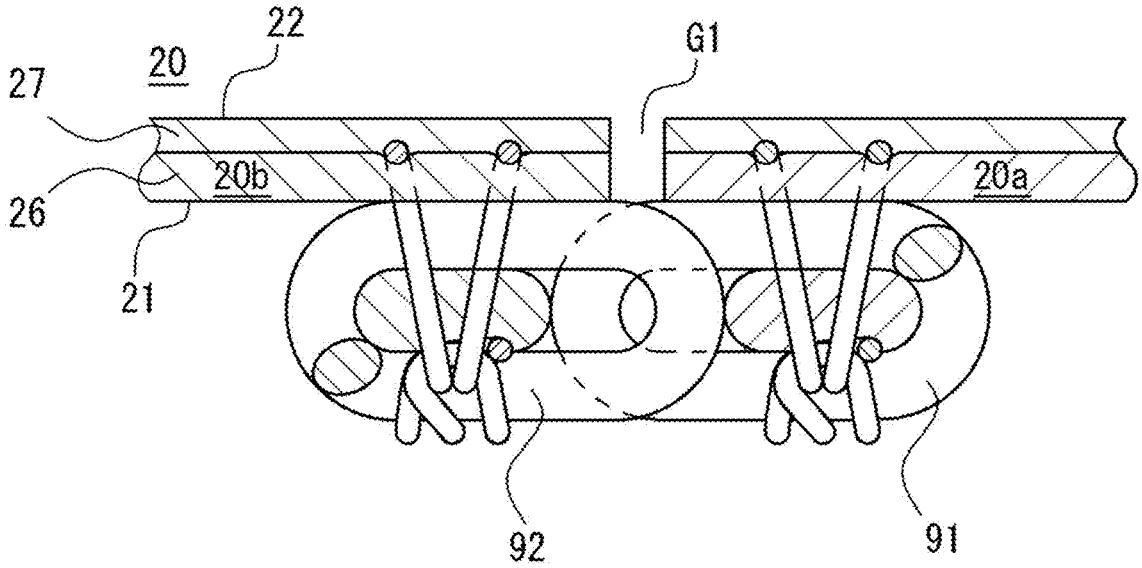
FIG. 3 is a schematic cross-sectional view showing engaged fastener elements of a slide fastener according to an aspect of the present disclosure.
Figure 4:
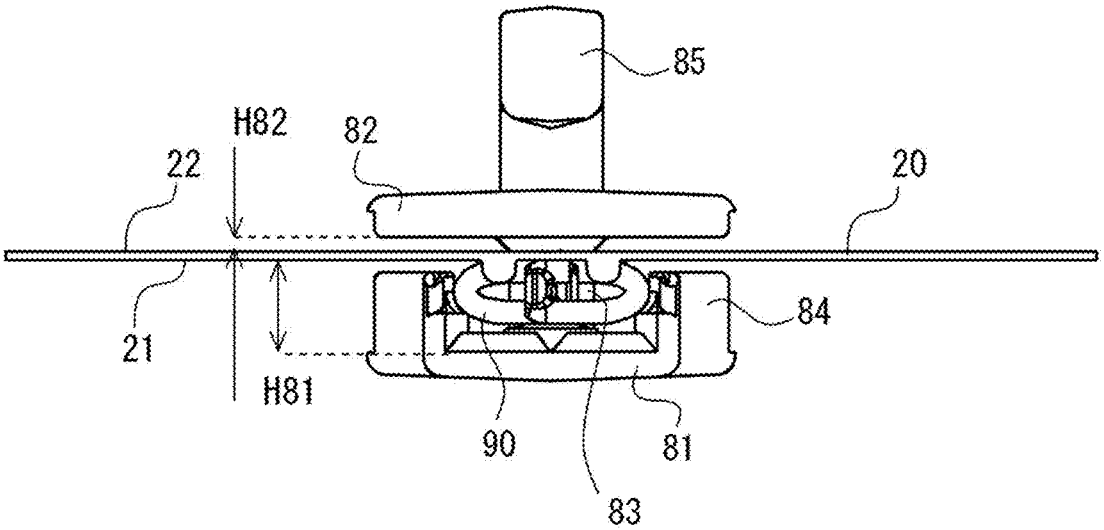
FIG. 4 is a schematic rear elevation of a slider for engaging and disengaging fastener elements of a slide fastener according to an aspect of the present disclosure.

FIG. 1 is a schematic perspective view of a first end of a slide fastener 1 according to an aspect of the present disclosure, showing a second surface 22 of a fastener tape 20. The stop member 10 and the slider 80 are not coupled, and a second portion 32 of a main body 30 of the stop member 10 do not touch the slider 80. FIG. 2 is a schematic perspective view of a first end of a slide fastener 1, showing a first surface 21 of a fastener tape 20. The stop member 10 and the slider 80 are not coupled, and thus legs 40 of the stop member 10 are not inserted into the slider 80. FIG. 3 is a schematic cross-sectional view showing engaged fastener elements 90 of a slide fastener 1. FIG. 4 is a schematic rear elevation of a slider 80 for engaging and disengaging fastener elements 90 of a slide fastener 1.

A slide fastener 1 has first and second fastener tapes 20*a*, 20*b* as a left-right pair of fastener tapes 20, and first and second fastener elements 91, 92 as a left-right pair of fastener elements 90. The slide fastener 1 is further provided with a stop member 10 which is made of plastic or resin. Also, the slide fastener 1 may optionally include a slider 80. In some cases, another stop member may be provided at the opposite, i.e. second end of the slide fastener 1, not necessarily limited to through.

The fastener tape 20 may be a flexible member having a first tape surface 21 and a second tape surface 22. The first and second tape surfaces 21, 22 of the fastener tape 20 are surfaces by which a thickness of the fastener tape 20 is defined. The fastener tape 20 is shaped like a rectangle elongated in a predetermined direction with a constant width. The elongated direction of the fastener tape 20 is indicated by an arrow in FIG. 1. The fastener tape 20 has a pair of long side-edges 23 and a pair of short side edges 24 which together define a web-like outline of the fastener tape 20. The left and right fastener tapes 20 are arranged in the left-right direction, and thus the long side-edge 23 of one fastener tape 20 and the long side-edge 23 of the other fastener tape 20 are adjacently arranged. The fastener elements 90 are provided to this adjacently arranged long side-edges 23 respectively, and therefore this side-edge can be referred to as an element-provided side-edge.

In some cases, the fastener tape 20 is a laminated tape of two or more layers, and this two or more layers may optionally include a first layer 26 that is a base fabric and a second layer 27 that is a water-repellent or water-resistant layer, not necessarily limited to through. It is envisaged that the water-repellent or water-resistant layer consists of plural layers of different material. For example, the base fabric may be made of a woven or knitted fabric or mixture thereof. For example, the water-repellent or water-resistant layer may be a coating layer of polymer such as polyurethane. FIG. 3 illustrates that a gap G1 exists between the left and right fastener tapes 20*a*, 20*b* when the left and right fastener elements 91, 92 are engaged. In some cases, the left and right fastener tapes 20*a*, 20*b* touch one another on their long side-edges 23 when the left and right fastener elements 91, 92 are engaged, thereby improving waterproofness or water-tightness of the slide fastener 1.

The fastener element 90 extends along the elongated direction of the fastener tape 20, and is provided on the long side-edge 23 of the fastener tape 20. The fastener element 90 can be any types such as metal-made element, plastic-made (resin-made) element and coil-like element. A coil-like element is illustrated as a fastener element 90, not necessarily limited to this though. In some cases, the fastener element 90 is a coil-like element, and is provided on the first tape surface 21 of the fastener tape 20, thereby flatness of the second tape surface 22 of the fastener tape 20 is ensured.

Frontward movement of the slider 80 toward the stop member 10 causes the left and right fastener elements 91, 92 to be engaged. In a process during which the left and right fastener elements 91, 92 are engaged, the left and right fastener tapes 20*a*, 20*b* can be brought into a state where they are touching one another on their long side-edges 23. Rearward movement of the slider 80 away from the stop member 10 causes the left and right fastener elements 91, 92 to be disengaged. In a process during which the left and right fastener elements 91, 92 are disengaged, the left and right fastener tapes 20*a*, 20*b* can be brought into a state where they are not touching one another on their long side-edges 23.

We note that a fastener stringer is an article in which the fastener element 90 is provided onto the fastener tape 20. When left and right fastener elements 91, 92 are engaged, the left and right fastener stringers are closed. When left and right fastener elements 91, 92 are disengaged, the left and right fastener stringers are opened, i.e. separated.

The slider 80 may be a slider that is made of metal or plastic/resin or other material. The slider 80 has a bottom wing 81 that is arranged at the first tape surface 21 side of the fastener tape 20, a top wing 82 that is arranged at the second tape surface 22 side of the fastener tape 20, and a coupling pillar 83 that couples the respective front end portions of the bottom wing 81 and the top wing 82. UP-down displacement of fastener element 90 is restricted between the bottom wing 81 and the top wing 82. The engaged fastener elements 90 will be split by the coupling pillar 83, and they are brought into disengaged state. A pair of front mouths are arranged so as to sandwich the coupling pillar 83. Via the respective front mouths, the respective fastener elements 90 enter into the inside of the slider 80 from the outside of the slider 80 or move from the inside of the slider 80 to the outside of the slider 80. One rear mouth is arranged opposite to the front mouths in the front-rear direction. Via this rear mouth, the engaged fastener elements 90 move into the inside of the slider 80 from the outside of the slider 80, or move from the inside of the slider 80 to the outside of the slider 80.

In some cases, the bottom wing 81 is provided with a pair of flanges 84 by which left and right fastener elements 91, 92 are restricted from being displaced in the left-right direction. On the other hand, the top wing 82 is not provided with such a pair of flanges by which movement of left and right fastener elements 91, 92 is restricted in the left-right direction. Alternatively or additionally, a distance H81 from the first tape surface 21 to the bottom wing 81 is greater than a distance H82 from the second tape surface 22 to the top wing 82. Alternatively or additionally, in some cases, the top wing 82 can move over the second tape surface 22 while touching the second tape surface 22. The slider 80 would be suitably adapted to the second tape surface 22 with the improved flatness.

In some cases, the slider 80 do not have an automatic stop functionality, i.e. the slider 80 do not have a stopping nail which actuates to be engaged with a fastener element 90. When the fastener tape 20 consists of plural layers, sliding resistance for a slider 80 would be increased. This disadvantage is now recognized as an advantage, allowing a slider 80 to have a simplified structure, and facilitating reduction of cost of a slide fastener 1. Note that, the slider 80 may have one or more pull-attachment columns 85. The pull-attachment column 85 may be provided on one or both of the bottom and top wings 81, 82. A non-illustrated pull tab can be attached to the pull-attachment column 85.

In some cases, the plastic stop member 10 of the slide fastener 1 is provided with a main body 30 fixed to both fastener tapes 20 of the slide fastener 1, and at least one leg 40 fixed to at least one fastener tape 20 and extending away from the main body 30. In a case where the stop member 10 is designed to prevent the frontward movement of the slider 80, the stop member 10 may have first and second legs 41, 42 as a left-right pair of legs 40. Each leg 40 is fixed to each fastener tape 20, and each leg 40 can be inserted into each front mouth of the slider 80. A passage P1 is provided between the first and second legs 41, 42 into which the coupling pillar 83 of the slider 80 can be inserted.

In a case where the stop member 10 is designed to prevent the rearward movement of the slider 80, the stop member 10 may have only one leg 40, the leg 40 may be fixed to both fastener tapes 20, and the leg 40 may be inserted into the rear mouth of the slider 80. Needless to say, an embodiment is envisioned where plural legs are provided which are inserted into the rear mouth of the slider 80.

In some cases, the stop member 10 may be made of at least one material selected from a group consisting of polyacetal and polyurethane. In some cases, the leg 40 has a flexibility that is enough for the leg 40 to be entrained by the fastener tape 20 to which it is fixed. For example, when a spacing between the left and right fastener tapes 20 is increased by pulling the left and right faster tapes 20 in the opposite directions in the left-right direction at a position slightly rearward from the stop member 10, the left and right legs 40 would be easily deformed from a parallel arrangement to be a tapered arrangement in which the spacing is increased rearward. Accordingly, reduction of flexibility of the slide fastener 1 would be avoided or suppressed even if the legs 40 are provided. As would be appreciated from the following descriptions, in some cases, the legs 40 are selectively provided on the first tape surface 21, and thus avoiding or suppressing reduced flexibility of the slide fastener 1.

The main body 30 includes a first portion 31 arranged on the first tape surfaces 21 of the fastener tape 20 and a second portion 32 arranged on the second tape surfaces 22 of the fastener tape 20 which are opposite to the first tape surfaces 21. The first portion 31 and the second portion 32 are coupled in the up-down direction and, in some cases, they are coupled in up-down direction in an interspace between the left and right fastener tapes 20. The main body 30 is a portion that is for facilitating sufficient fixing of the stop member 10 to the fastener tape 20, but can take various shapes or sizes in accordance with other novel function-based requests or design-based requests. As would be well understood from FIG. 9, in some cases, the maximum height H1 of the first portion 31 measured from the first tape surface 21 is greater than the maximum height H2 of the second portion 32 measured from the second tape surface 22. Accordingly, a degree of reduced flatness of the second tape surface 22 may be suppressed.

In some cases, the second portion 32 has a recessed portion 33 that is recessed in accordance with a front contour of the top wing 82 or the bottom wing 81 of the slider 80 for opening and closing the slide fastener 1. This would facilitate intimate contact of the slider 80 and the stop member 10, and a spacing caused between the slider 80 and the stop member 10 would be facilitated to be minimized. In some cases, the recessed portion 33 has a continuous arc surface 34 that is recessed in accordance with a front contour of the top wing 82 or the bottom wing 81, and first-side and second-side wall surfaces 35, 36 extending along the elongated direction of the fastener tape 20. A first protrusion 37 is defined between the first-side wall surface 35 and the arc surface 34, and a second protrusion 38 is defined between the second-side wall surface 36 and the arc surface 34.

The arc surface 34, and the first-side and second-side wall surfaces 35, 36 are wall surface regions included in a peripheral wall surface 39 of the second portion 32. The arc surface 34 extends in a range across the left and right fastener tapes 20. The arc surface 34 may have a length across the entire width of the second portion 32 in the left-right direction. The first-side and second-side wall surfaces 35, 36 may stand upright from the second tape surface 22 of the fastener tape 20. The first protrusion 37 may have a width in the left-right direction which is gradually reduced toward its terminal end. Likewise, the second protrusion 38 may have a width in the left-right direction which is gradually reduced toward its terminal end.

The leg 40 is a portion at least partially inserted into the slider 80, facilitating engaging or coupling of the stop member 10 and the slider 80. The front or rear mouth of the slider 80 may be substantially sealed by the leg 40 so that water channel through the internal space of the slider 80 would be reduced or obstructed. In some cases, an end of the coil-like fastener element 90 of the slide fastener 1 is embedded in the at least one leg 40. The coil-like fastener element 90 would be attached to the fastener tape 20 with sufficient attachment strength. In a case where the legs 40 are selectively provided on the first tape surface 21, there may be a possibility that sufficient attachment strength of the legs 40 to the fastener tape 20 is not secured. Embedding of the end of the coil-like fastener element in the leg 40 would facilitate improved attachment strength of the leg 40 to the fastener tape 20.

Figure 5:
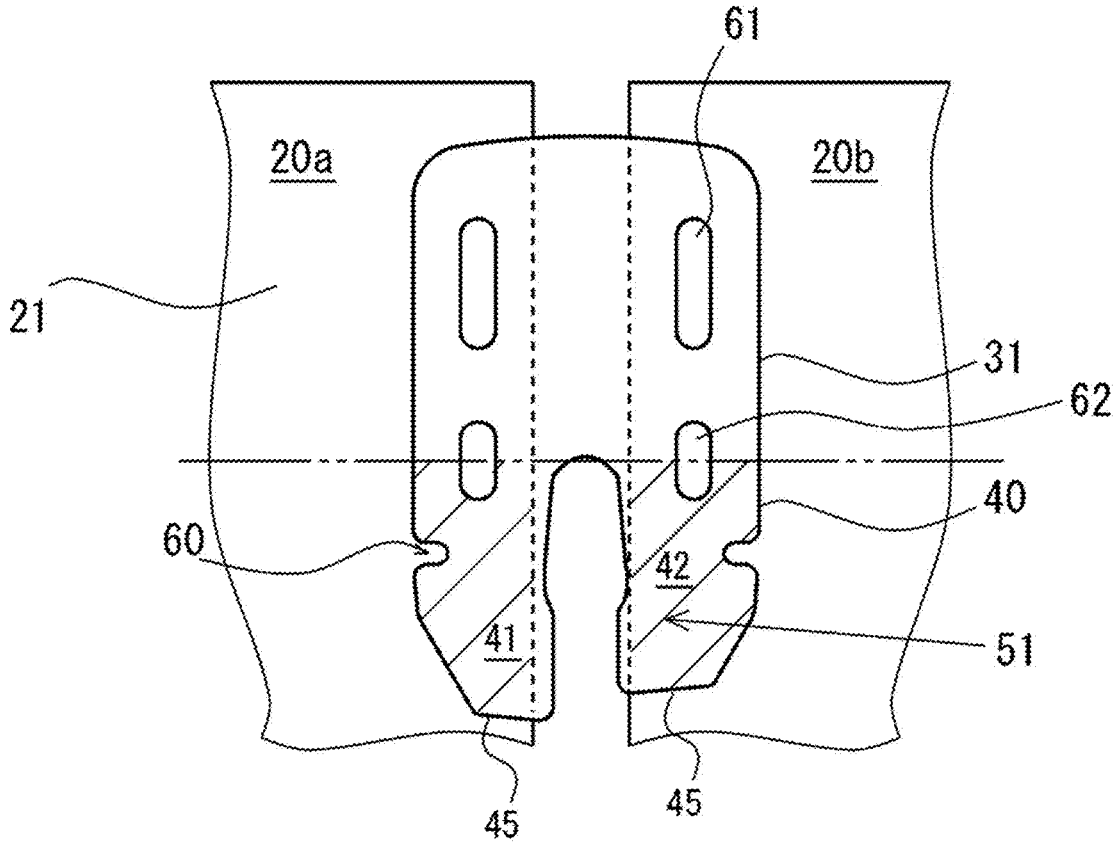
FIG. 5 is a schematic elevation of a stop member of a slide fastener according to an aspect of the present disclosure, schematically illustrating that a leg covers a first region included in a first tape surface of a fastener tape.
Figure 6:
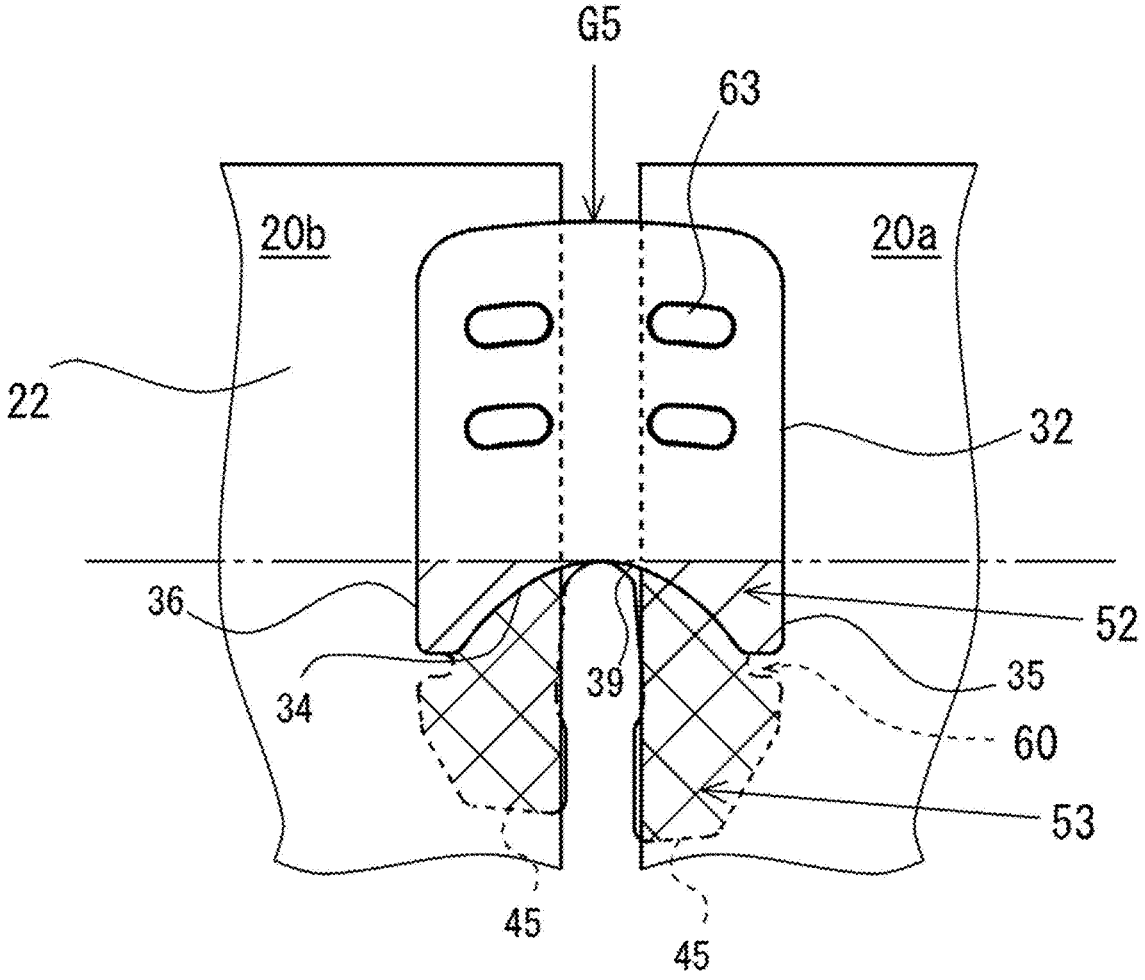
FIG. 6 is a schematic elevation of a stop member of a slide fastener according to an aspect of the present disclosure, schematically illustrating that a bare region is included in a second region of a second tape surface that is opposite to a first region of a first tape surface. The bare region extends from a peripheral wall surface of a second portion toward a terminal end of a leg.
Figure 7:
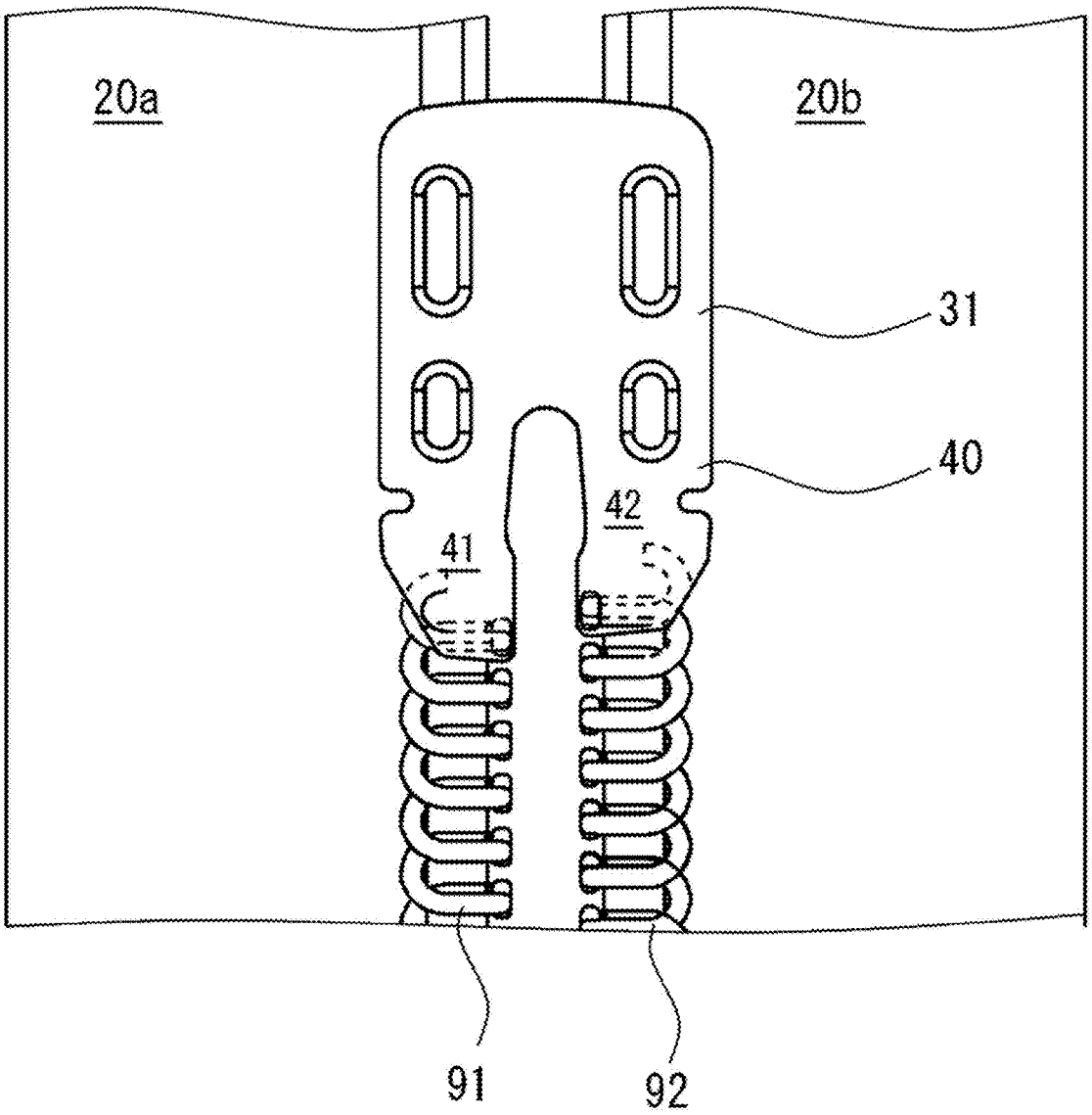
FIG. 7 is a schematic elevation, schematically illustrating that an end of a coil-like fastener element is embedded in a leg in a slide fastener according to an aspect of the present disclosure.
Figure 8:
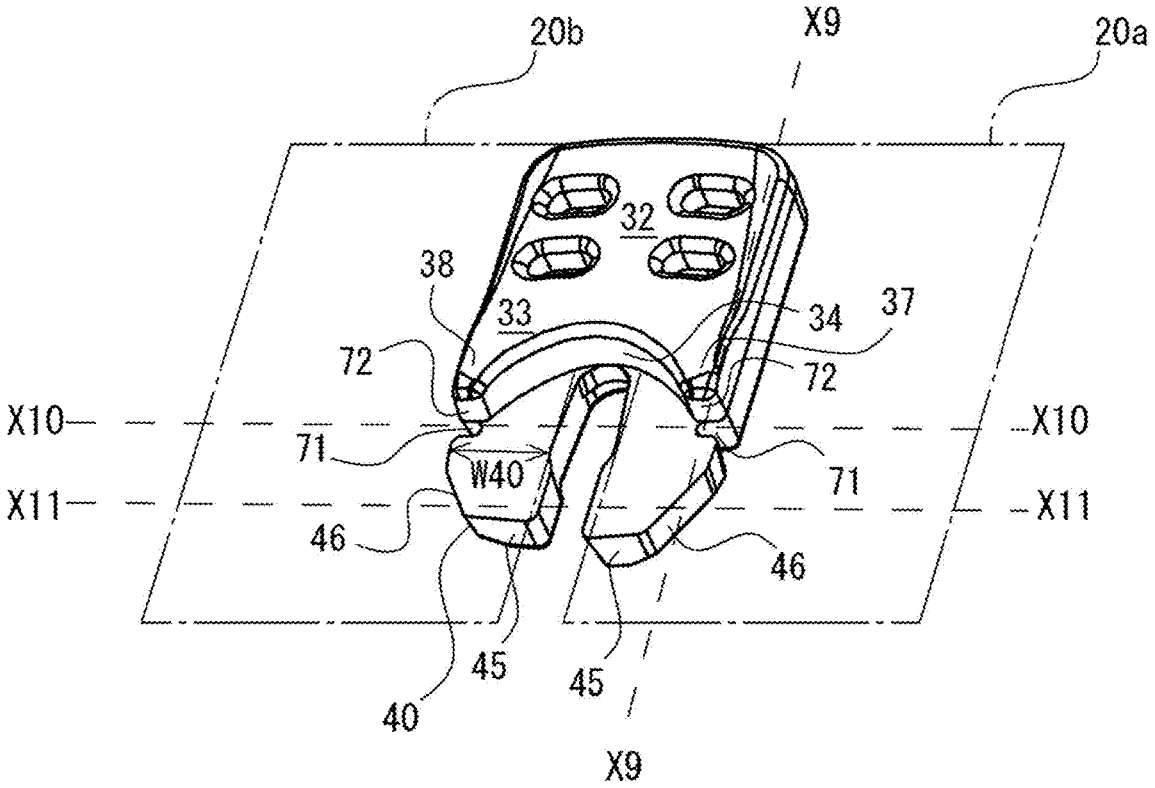
FIG. 8 is a schematic perspective view of a stop member of a slide fastener according to an aspect of the present disclosure in which a dash-dotted line indicates an imaginary fastener tape.
Figure 9:
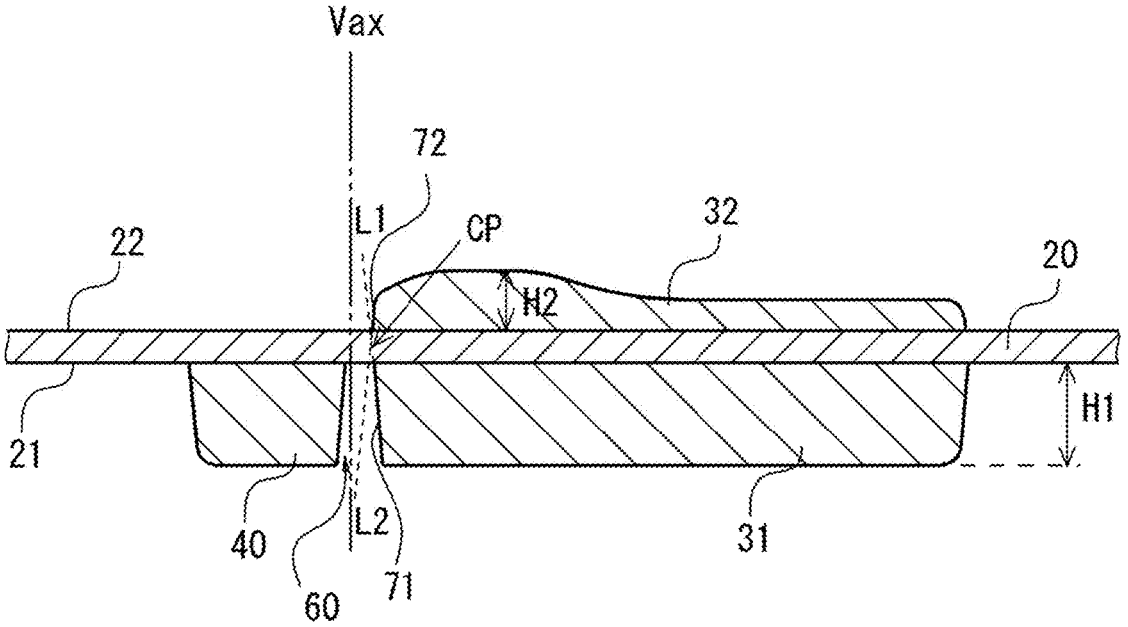
FIG. 9 is a schematic end view taken along a dash line X9-X9 in FIG. 8.
Figure 10:
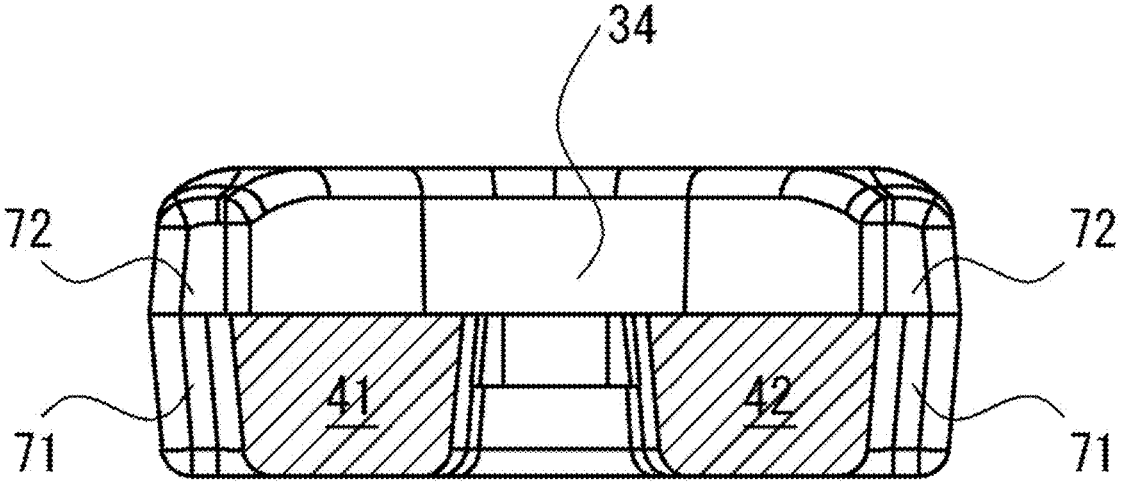
FIG. 10 is a schematic end view taken along a dash line X10-X10 in FIG. 8. Illustration of fastener tape is omitted for convenience of simple illustration.
Figure 11:
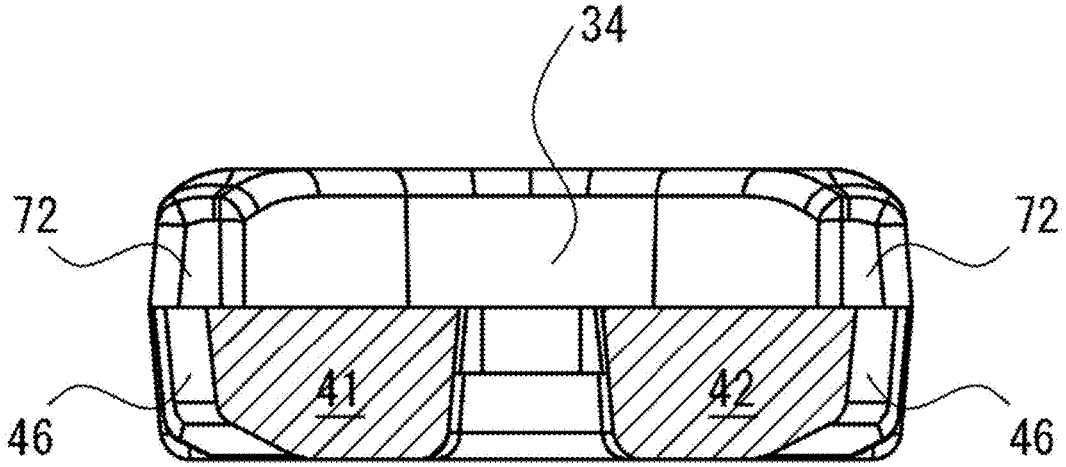
FIG. 11 is a schematic end view taken along a dash line X11-X11 in FIG. 8. Illustration of fastener tape is omitted for convenience of simple illustration.
Figure 12:
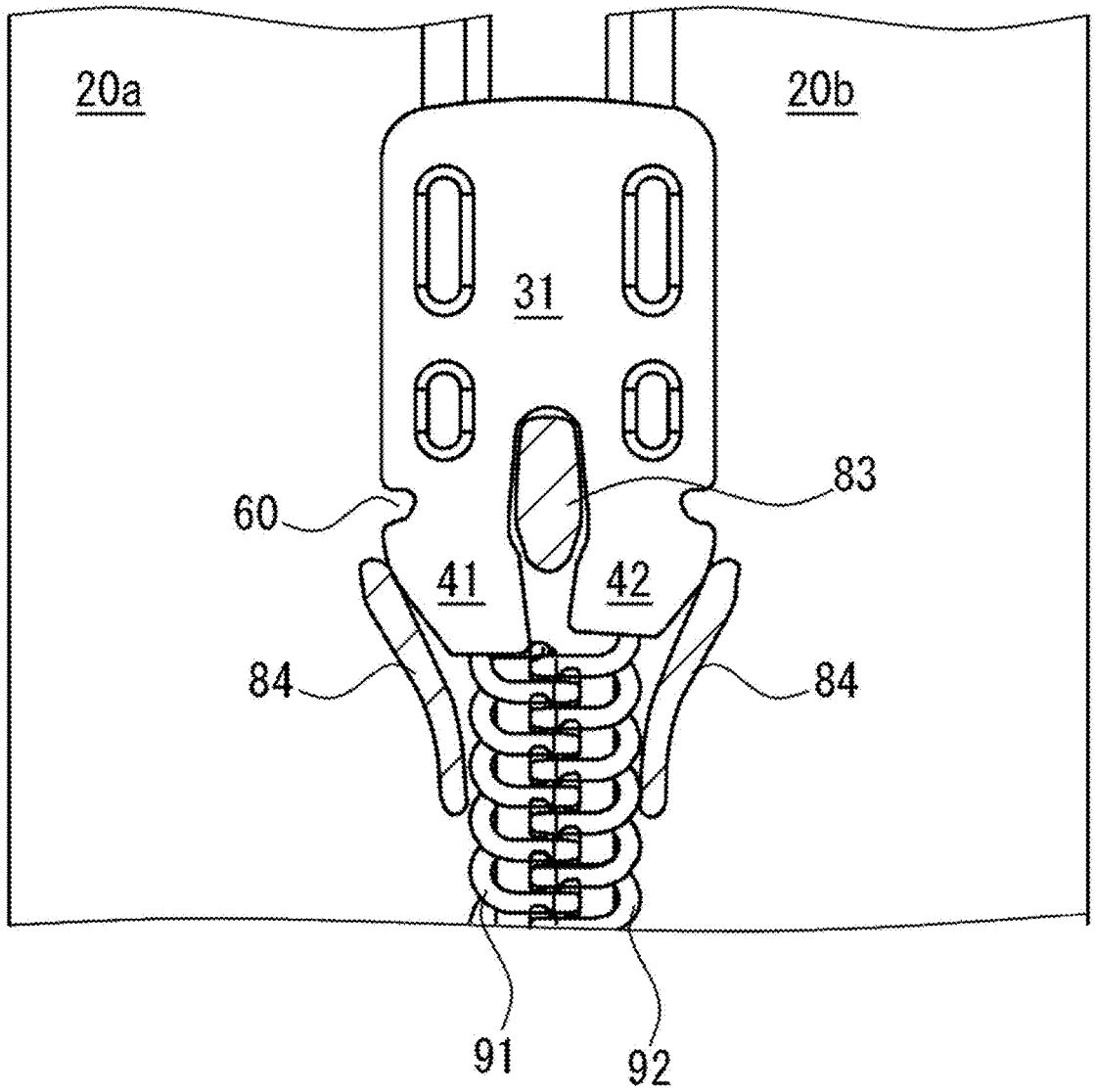
FIG. 12 is a schematic view showing a state in which a slider and a stop member are coupled as a result of frontward movement of the slider toward the stop member in a slide fastener according to an aspect of the present disclosure.

FIG. 5 schematically illustrates that the leg 40 covers a first region 51 included in the first tape surface 21 of the fastener tape 20. FIG. 6 schematically illustrates that a bare region 53 of the second tape surface 22 is included in a second region 52 of the second tape surface 22 that is opposite to the first region 51 of the first tape surface 21. The bare region 53 extends from the peripheral wall surface 39 of the second portion 32 toward the terminal end 45 of the leg 40. FIG. 7 is a schematic elevation, schematically illustrating that the end of the coil-like fastener element is embedded in the leg. FIG. 8 is a schematic perspective view of the stop member 10 in which a dash-dotted line indicates an imaginary fastener tape 20. FIG. 9 is a schematic end view taken along a dash line X9-X9 in FIG. 8. FIG. 10 is a schematic end view taken along a dash line X10-X10 in FIG. 8. FIG. 11 is a schematic end view taken along a dash line X11-X11 in FIG. 8. FIG. 12 is a schematic view showing a state in which the slider 80 and the stop member 10 are coupled as a result of frontward movement of the slider 80 toward the stop member 10.

In some cases, the leg 40 is coupled to the first portion 31 of the main body 30 and also covers the first region 51 included in the first tape surface 21 of the fastener tape 20. Hatched region in FIG. 5 explicitly indicates the first region 51 of the first tape surface 21 which is covered by the leg 40. In some cases, the bare region 53 is included in the second region 52 of the second tape surface 22 which is opposite to the first region 51 of the first tape surface 21. Hatched and lattice regions in FIG. 6 explicitly illustrate the second region 52 of the second tape surface 22 which is opposite to the first region 51 of the first tape surface 21. The lattice region in FIG. 6 explicitly illustrates the bare region 53 included in the second region 52.

The bare region 53 extends from the peripheral wall surface 39 of the second portion 32 toward the terminal end 45 of the leg 40. Additionally or alternatively, the bare region 53 extends between or extends across a distance between the peripheral wall surface 39 of the second portion 32 and the terminal end 45 of the leg 40. In such configurations, the legs 40 are selectively provided on the first tape surface 21, and thus a degree of reduced flexibility of the slide fastener 1 around the stop member 10 would be less. Furthermore, a degree of reduced flatness at the second tape surface 22 side would be less. As described above, in some cases, the end of the coil-like fastener element 90 is embedded in the leg 40, thereby avoiding or suppressing reduced attachment strength of the leg 40 to the fastener tape 20 which is caused in a case where the leg 40 is selectively provided on the first tape surface 21.

In some cases, the peripheral wall surface 39 of the second portion 32 includes a first peripheral wall surface standing upright from the first tape surface 21, second peripheral wall surface standing upright from the second tape surface 22, and a connecting surface connecting the first and second peripheral wall surfaces. The second region 52 is a region included in the second tape surface 22, and is a region partially covered by the second portion 32. The bare region 53 is a region included in the second tape surface 22, and is a region not covered by the second portion 32. The region covered by the second portion 32 in the second region 52 may be referred to as a third region. In some cases, the area of the third region is smaller than the area of the bare region 53. Accordingly, a degree of reduced flexibility of the slide fastener 1 would be less.

The legs 40 may be provided with a hole 60 that reaches the first tape surface 21 of the fastener tape 20. The hole 60 is formed in accordance with a pin that restricts displacement of the fastener tape 20 during injection-molding of the stop member 10 to the fastener tape 20. The hole 60 may be provided so as to form a groove on the peripheral wall surface 39 of at least one leg 40. Alternatively or additionally, the hole 60 may be provided to facilitate pivoting of at least one leg 40. As would be well understood by comparing FIGS. 7 and 12, when the leg 40 is inserted into the slider 80, the leg 40 pivots as being pushed by the flange 84. In some cases, the hole 60 facilitates light pivoting of the leg 40. A diameter or width of the hole 60 can be gradually reduced as being closer to the first tape surface 21.

Holes 61 can also be provided in the first portion 31 of the main body 30, not necessarily limited to through. Holes 62 can be provided which cross a border line (see the phantom lines) between the first portion 31 of the main body 30 and the leg 40. Holes 63 can also be provided in the second portion 32 of the main body 30. The holes 61, 62 are holes reaching the first tape surface 21. The holes 63 are holes reaching the second tape surface 22. The holes 60-63 may extend in the up-down direction and may have a varying or constant width along the up-down direction. The contour of the hole 60~63 may be shaped variously such as perfect circle, oval, or polygon with rounded corners.

As stated at the beginning, the stop member may be produced by arranging a fastener tape in a mold and supplying a melt into a cavity of the mold, and therefore the fastener tape may possibly be shaken or displaced in the cavity of the mold due to supply pressure or flow of the melt. Common technical presumption is that, from such an aspect, the leg should be shaped to have top and bottom halves above and below the fastener tape which are shaped identically, thereby equalizing flow of melt in the top half of the cavity above the fastener tape and flow of melt in the bottom half of the cavity below the fastener tape.

In contrast, in some cases according to the present disclosure, the leg 40 is selectively provided on the first tape surface 21, and a half of the leg does not exist on the second tape surface 22. At the time of injection-molding of the stop member 10, the fastener tape 20 would be pushed by the melt which has reached a wall surface of the mold which is for shaping the peripheral wall surface 39 of the second portion 32 of the main body 30. This may cause local displacement of the fastener tape 20 toward a space for forming the leg 40 and, as a result, a molding defect can be caused such as a small protrusions on the second portion 32. The above described-pins can be used to suppress such undesired local displacement of the fastener tape 20. As a result of the use of such pins, molding defects can be avoided or suppressed. As would be well understood from FIG. 6, in some cases, a pin is positioned at an appropriate position and, as a result of this, the hole 60 is formed on the opposite side of the peripheral wall surface 39 of the second portion 32 and is offset toward the terminal end 45 of the leg 40 relative to the peripheral wall surface 39. Optionally, the contour of the hole 60 and the contour of the peripheral wall surface 39 do not cross or overlap.

Additionally or alternatively, as would be understood from FIG. 9, a first wall surface region 71 included in a wall surface defining the hole 60 and a second wall surface region 72 included in the peripheral wall surface 39 of the second portion 32 extend along a common axial line Vax that is orthogonal to the tape surface of the fastener tape 20. A first extended line L1 of the first wall surface region 71 and a second extended line L2 of the second wall surface region 72 cross at a point between the first and second tape surfaces 21, 22 of the fastener tape 20. FIG. 9 illustrates that the first extended line L1 of the first wall surface region 71 and the second extended line L2 of the second wall surface region 72 cross at an intersection point CP between the first tape surface 21 and the second tape surface 22. In some cases, the length of the first wall surface region 71 along the axial line Vax is greater than the length of the second wall surface region 72 along the axial line Vax. This avoids or suppress molding defects of the second portion 32 of the main body 30 due to that the leg 40 is selectively provided on the first tape surface 21.

The most appropriate position of hole 60 for suppressing the molding defect of the second portion 32 may be dependent onto a contour of the peripheral wall surface 39 of the second portion 32 and, in some cases, may be dependent onto other factors such as the position of gate, inflow speed of material, or coefficient of viscosity of material. In a case where the recessed portion 33 of the second portion 32 is provided with the above-described first protrusion 37 and/or second protrusion 38, the melt entering via a gate positioned at G5 as illustrated by an arrow in FIG. 6 would flow in a narrowing flow-channel that is for forming the first protrusion 37 and/or the second protrusion 38. As a result, molding defect(s) might be induced nearby the terminal end of the first protrusion 37 and/or the second protrusion 38.

In view of the above concerns, in some cases, (i) the hole 60 is provided on the opposite side of the peripheral wall surface 39 positioned at the terminal end of the first protrusion 37 and/or the second protrusion 38, and is offset toward the terminal end 45 of the leg 40 relative to the peripheral wall surface 39; or (ii) a first wall surface region 71 included in a wall surface defining the hole 60 and a second wall surface region 72 included in the peripheral wall surface 39 positioned at the terminal end of the first protrusion 37 or the second protrusion 38 extend along a common axial line Vax that is orthogonal to the tape surface of the fastener tape 20. Accordingly, as described above, induced molding defects would be avoided or suppressed. In some cases, the first protrusion 37 and/or the second protrusion 38 is provided so as not to overlap the hole 60.

Additionally or alternatively, a first wall surface region 71 included in a wall surface defining the hole 60 and a second wall surface region 72 included in the peripheral wall surface 39 of the first protrusion 37 or the second protrusion 38 extend along a common axial line Vax that is orthogonal to the tape surface of the fastener tape 20. The first extended line L1 of the first wall surface region 71 and the second extended line L2 of the second wall surface region 72 may cross at a point between the first and second tape surfaces 21, 22 of the fastener tape 20.

As would be well understood from FIGS. 8, 10, and 11, the leg 40 may be shaped to facilitate its smooth insertion into the slider 80. The leg 40 may have a width W40 in the left-right direction which is gradually decreased as being away from the main body 30. The leg 40 may have a first sloped surface 46 that is slant between the hole 60 and the terminal end 45 of the leg 40 so as to reduce the width W40 of the leg 40 in the left-right direction. The first sloped surface 46 may touch the flange 84 coupled to the bottom wing 81 of the slider 80, and may be pushed by the flange 84. As shown in FIG. 2, the leg 40 may have a second sloped surface 47 that is slant between the hole 60 and the terminal end 45 of the leg 40 so as to reduce the thickness of the leg 40. The second sloped surface 47 can touch the bottom wing 81 of the slider 80, and guide the insertion of the leg 40 into the slider 80.

Given the above teachings, a skilled person in the art would be able to add various modifications to the respective embodiments. Reference codes in Claims are just for reference and should not be referred for purposes of narrowly construing the scope of claims.

What is claimed is:

1. A stop member comprising:

a main body fixed to first and second fastener tapes of a slide fastener, the main body including a first portion arranged on first tape surfaces of the first and second fastener tapes and a second portion arranged on second tape surfaces of the first and second fastener tapes, the second tape surfaces of the first and second fastener tapes being opposite to the first tape surfaces of the first and second fastener tapes; and a first leg fixed to the first fastener tape and coupled to the first portion of the main body, the first leg extending away from the first portion of the main body in an elongated direction, the first leg covering a first region of the first tape surface of the first fastener tape, and the first leg having a terminal end positioned farthest from the first portion, wherein the second tape surface of the first fastener tape includes a second region that is opposite to the first region of the first tape surface of the first fastener tape, the second region includes a bare region of the second tape surface of the first fastener tape, the bare region extending from a peripheral wall surface of the second portion toward a point opposite the terminal end of the first leg.

2. The stop member according to claim 1, wherein the first leg is provided with a hole that reaches the first tape surface of the fastener tape.

3. The stop member according to claim 2, wherein the hole provided on the first tape surface is positioned on the opposite side of the peripheral wall surface of the second portion and/or is offset toward the terminal end of the first leg relative to the peripheral wall surface of the second portion.

4. The stop member according to claim 2, wherein the hole is defined by a wall surface including a first wall surface region; the peripheral wall surface of the second portion includes a second wall surface region; and the first and second wall surface regions extend along a common axial line that is orthogonal to the first and second tape surfaces of the first fastener tape.

5. The stop member according to claim 4, wherein a first extended line of the first wall surface region and a second extended line of the second wall surface region cross at a point between the first and second tape surfaces of the first fastener tape.

6. The stop member according to claim 4, wherein a length of the first wall surface region along the axial line is greater than a length of the second wall surface region along the axial line.

7. The stop member according to claim 2, wherein the hole is provided so as to form a groove on a peripheral wall surface of the first leg.

8. The stop member according to claim 7, wherein the hole is provided to facilitate pivoting of the first leg.

9. The stop member according to claim 1, wherein the second portion has a recessed portion that is recessed in accordance with a front contour of a top or bottom wing of a slider of the slide fastener.

10. The stop member according to claim 9, wherein the recessed portion comprises first and second protrusions, and a distance between the first and second protrusions is gradually increased as the first and second protrusions extend.

11. The stop member according to claim 9, wherein the recessed portion comprises:

a continuous arc surface that is recessed in accordance with the front contour of the top or bottom wing; and first-side and second-side wall surfaces extending along the elongated direction of the fastener tape, and wherein a first protrusion is at least partially defined by the first-side wall surface and the arc surface, and a second protrusion is at least partially defined by the second-side wall surface and the arc surface.

12. The stop member according to claim 11, wherein the first leg is provided with a hole that reaches the first tape surface of the fastener tape, and wherein (i) the hole provided on the first tape surface is located at the opposite side of the peripheral wall surface of a terminal end of the first or second protrusion, and the hole provided on the first tape surface is offset toward the terminal end of the first leg relative to the peripheral wall surface; or (ii) a first wall surface region included in a wall surface defining the hole and a second wall surface region included in the peripheral wall surface of a terminal end of the first or second protrusion extend along a common axial line, the common axial line extending orthogonal to the first and second tape surfaces of the first fastener tape.

13. The stop member according to claim 1, wherein the first leg is flexible enough to be entrained by the fastener tape to which the first leg is fixed.

14. The stop member according to claim 1, wherein an end of a coil-like fastener element included in the slide fastener is embedded in the first leg.

15. The stop member according to claim 1, the stop member further comprises a second leg fixed to the second fastener tape and coupled to the first portion of the main body, the second leg extending away from the first portion of the main body, the second leg covering a third region of the first tape surface of the second fastener tape, and the second leg having a terminal end positioned farthest from the first portion, wherein the second tape surface of the second fastener tape includes a fourth region that is opposite to the third region of the first tape surface of the second fastener tape, the fourth region including a bare region of the second tape surface of the second fastener tape, and the bare region extending from a peripheral wall surface of the second portion toward a point opposite the terminal end of the second leg.

16. A slide fastener comprising the stop member of claim 1.

17. A slide fastener comprising:

first and second fastener tapes, each of which including top and bottom tape surfaces, and the bottom tape surfaces of the first and second fastener tapes being opposite to the top tape surfaces of the first and second fastener tapes;

first and second fastener elements respectively provided on the bottom tape surfaces of the first and second fastener tapes;

a slider for engaging and disengaging the first and second fastener elements; and a stop member configured to prevent frontward or rearward movement of the slider, wherein the stop member comprises:

a main body fixed to the first and second fastener tapes, the main body including a lower portion provided on the bottom tape surfaces of the first and second fastener tapes and an upper portion provided on the top tape surfaces of the first and second fastener tapes; and a first leg coupled to the lower portion of the main body, the first leg extending away from the lower portion of the main body in an elongated direction, the first leg covering a first region of the bottom tape surface of the first fastener tape, and the first leg having a terminal end positioned farthest from the lower portion, wherein the top tape surface of the first fastener tape includes a second region that is opposite to the first region of the bottom tape surface of the first fastener tape, the second region including a bare region of the top tape surface of the first fastener tape, and the bare region extending from a peripheral wall surface of the upper portion toward a first point opposite the terminal end of the first leg.

18. The slide fastener of claim 17, wherein the stop member further comprises a second leg coupled to the lower portion of the main body, the second leg extending away from the lower portion of the main body, the second leg covering a third region of the bottom tape surface of the second fastener tape, and the second leg having a terminal end positioned farthest from the lower portion, wherein the top tape surface of the second fastener tape includes a fourth region that is opposite to the third region of the bottom tape surface of the second fastener tape, the fourth region including a bare region of the top tape surface of the second fastener tape, and the bare region extending from a peripheral wall surface of the upper portion toward a second point opposite the terminal end of the second leg.

19. The slide fastener of claim 18, wherein each of the first and second legs is provided with a hole such that pivoting of the leg is allowed.

20. The slide fastener of claim 17, wherein the upper portion has a recessed portion that is recessed in accordance with a front contour of a top wing of the slider.

* * * * *